US012146407B2

(12) United States Patent
Pesola

(10) Patent No.: US 12,146,407 B2
(45) Date of Patent: Nov. 19, 2024

(54) MINE VEHICLE BOOM POSITIONING CONTROL

(71) Applicant: SANDVIK MINING AND CONSTRUCTION OY, Tampere (FI)

(72) Inventor: Mikko Pesola, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 343 days.

(21) Appl. No.: 17/440,393

(22) PCT Filed: Mar. 17, 2020

(86) PCT No.: PCT/EP2020/057353
§ 371 (c)(1),
(2) Date: Sep. 17, 2021

(87) PCT Pub. No.: WO2020/187947
PCT Pub. Date: Sep. 24, 2020

(65) Prior Publication Data

US 2022/0162911 A1 May 26, 2022

(30) Foreign Application Priority Data

Mar. 19, 2019 (EP) ..... 19163792

(51) Int. Cl.
*E21B 7/02* (2006.01)
*E21D 9/00* (2006.01)

(52) U.S. Cl.
CPC ..... *E21B 7/025* (2013.01); *E21D 9/006* (2013.01)

(58) Field of Classification Search
CPC ..... E21B 7/025; E21B 7/022; E21B 44/00; E21D 9/006
See application file for complete search history.

(56) References Cited

U.S. PATENT DOCUMENTS 6,004,016 A 12/1999 Spector
2007/0240903 A1* 10/2007 Alft ..... E21B 7/28 175/50

(Continued)

FOREIGN PATENT DOCUMENTS

CN 105353776 B 4/2018
WO 2018184916 A1 10/2018

OTHER PUBLICATIONS

Kivela et al: "Redundant Robotic Manipulator Path Planning for Real-Time Obstacle and Self-Collision Avoidance", Mechanisms, Transmissions and Applications, vol. 49 (Year: 2017).*

(Continued)

*Primary Examiner* — Anne Marie Antonucci
*Assistant Examiner* — Patrick Daniel Mohl
(74) *Attorney, Agent, or Firm* — Corinne R. Gorski

(57) ABSTRACT

A method for generation of a boom trajectory for automated boom positioning includes the steps of receiving target pose data indicative of at least target position of a first boom object of the boom for positioning a work machine of the mine vehicle to a target pose in accordance with a mine work plan, receiving geometry data of the first boom object, the geometry data being mapped with start pose data indicative of the start position and orientation of the first boom object, receiving obstacle data, selecting trajectory generation locations for the first boom object, and generating, before starting positioning of the work machine for the target pose, a positioning trajectory for each of the selected trajectory generation locations on the basis of the target pose data, the geometry data, the start pose data, and the obstacle data.

15 Claims, 6 Drawing Sheets

(56) References Cited

U.S. PATENT DOCUMENTS

| | | | | |
|---|---|---|---|---|
| 2010/0223008 | A1 | 9/2010 | Dunbabin et al. | |
| 2016/0059415 | A1* | 3/2016 | Guerin | B25J 9/1664 901/4 |
| 2016/0123146 | A1* | 5/2016 | Makela | E21B 7/022 701/50 |
| 2019/0078291 | A1* | 3/2019 | Shimano | E02F 3/437 |

OTHER PUBLICATIONS

Kivela et al: "Redundant Robotic Manipulator Path Planning for Real-Time Obstacle and Self-Collision Avoidance", Mechanisms, Transmissions and Applications, vol. 49, Jan. 1, 2017, pp. 208-216, Dordrecht, Netherlands.

Fink B et al: "Development of A An advanced Cartesian Controlled Drilling Boom", IECON '98. Proceedings of the 24th Annual Conference of the IEEE Industrial Electronics Society, AACHEN, Aug. 31-Sep. 4, 1998; New York, NY, pp. 1922-1925.

* cited by examiner

MINE VEHICLE BOOM POSITIONING CONTROL

RELATED APPLICATION DATA

This application is a § 371 National Stage Application of PCT International Application No. PCT/EP2020/057353 filed Mar. 17, 2020 claiming priority to EP 19163792.5 filed Mar. 19, 2019.

FIELD

The present invention relates to controlling positioning of an underground mine vehicle boom, and in particular to generation of boom trajectory for automated boom positioning.

BACKGROUND

Mine vehicles, such as, drilling rigs or bolting vehicles, are used in underground construction and mining sites. In drilling-blasting based methods rock is excavated in rounds. Several successive rounds produce a tunnel having a tunnel face. At first drill holes are drilled to the tunnel face, where after the drilled holes are charged and blasted. Rock material of the amount of one round is detached at one blasting time. The detached rock material is transported away from the tunnel for further treatments.

For excavating rock, a mine excavation plan, which may comprise at least one drilling pattern, or drill hole pattern, is made in advance and information on the rock type, for example, is determined. Typically, the drilling pattern is designed as office work for each round. The pattern is provided for the rock drilling rig to drill holes in the rock in such a way that a desired round and tunnel profile can be achieved.

The mine vehicles are provided with one or more booms and mine working tools, such as drilling machine or bolting tool at distal ends of the booms. Typically the mine work tool needs to be positioned to exact positions, which may be determined in a mine or drilling plan, for example. The boom comprises one or more boom parts and joints between them. Controlling of the boom in confined mine spaces is demanding and collisions between the boom and obstacles may exist. Therefore, collision avoidance systems are needed for the mine vehicles. However, the present systems have shown to contain some disadvantages.

SUMMARY

According to a first aspect of the present invention, there is provided an apparatus, being configured to or comprising means configured for performing at least: controlling a first boom object of a boom of a mine vehicle for positioning a work machine of the mine vehicle to a target pose in accordance with a mine work plan, wherein the apparatus comprises a boom trajectory planner configured to perform, before starting positioning of the work machine for the target pose, positioning trajectory generation for controlling the first boom object from a starting position to a target position for positioning the work machine to the target pose, the positioning trajectory generation comprising receiving target pose data indicative of at least target position of the first boom object for positioning the work machine to the target pose in accordance with the mine work plan, receiving geometry data of the first boom object, the geometry data being mapped with start pose data indicative of the start position and orientation of the first boom object, receiving obstacle data, selecting trajectory generation locations for the first boom object, and generating a positioning trajectory for each of the selected trajectory generation locations on the basis of the target pose data, the geometry data, the start pose data, and the obstacle data.

According to a second aspect of the present invention, there is provided a method for underground mine vehicle boom trajectory generation, comprising: receiving target pose data indicative of at least target position of a first boom object of the boom for positioning a work machine of the mine vehicle to a target pose in accordance with a mine work plan, receiving geometry data of the first boom object, the geometry data being mapped with start pose data indicative of the start position and orientation of the first boom object, receiving obstacle data, selecting trajectory generation locations for the first boom object, and generating, before starting positioning of the work machine for the target pose, a positioning trajectory for each of the selected trajectory generation locations on the basis of the target pose data, the geometry data, the start pose data, and the obstacle data.

According to a third aspect, there is provided an apparatus comprising at least one processing core, at least one memory including computer program code, the at least one memory and the computer program code being configured to, with the at least one processing core, cause the apparatus at least to perform the method or an embodiment of the method.

According to a fourth aspect, there is provided a computer program, a computer program product or (a non-tangible) computer-readable medium comprising computer program code for, when executed in a data processing apparatus, to cause the apparatus to perform the method or an embodiment thereof.

According to an embodiment of any of the aspects, positioning trajectories for each of the selected trajectory generation locations are generated by a trajectory experimentation algorithm configured to experiment available trajectory options by applying a set of cost functions. The set of cost functions may comprise at least some of distance to the obstacle, direction of obstacle circumvention, and distance to another object of the boom, for example.

According to an embodiment of any of the aspects, a 3D trajectory is defined for the boom on the basis of at least some the positioning trajectories.

According to an embodiment of any of the aspects, boom trajectory information is provided based on at least some of the positioning trajectories to a boom controller configured to define boom actuator control commands on the basis of the received boom trajectory information.

According to an embodiment of any of the aspects, trajectory status for at least some of the positioning trajectories is analyzed, and use of at least one of the positioning trajectories is controlled on the basis of a trajectory status of the positioning trajectory. In a further embodiment, positioning of the first boom object is delayed on the basis of the trajectory status or change to another target pose of the mine work plan on the basis of the trajectory status.

According to an embodiment, the boom trajectory planner is provided with 3D scanning data produced by means of at least one scanning device; and the boom trajectory planner is configured to utilize the scanning data as the obstacle data.

EMBODIMENTS

Figure 1:
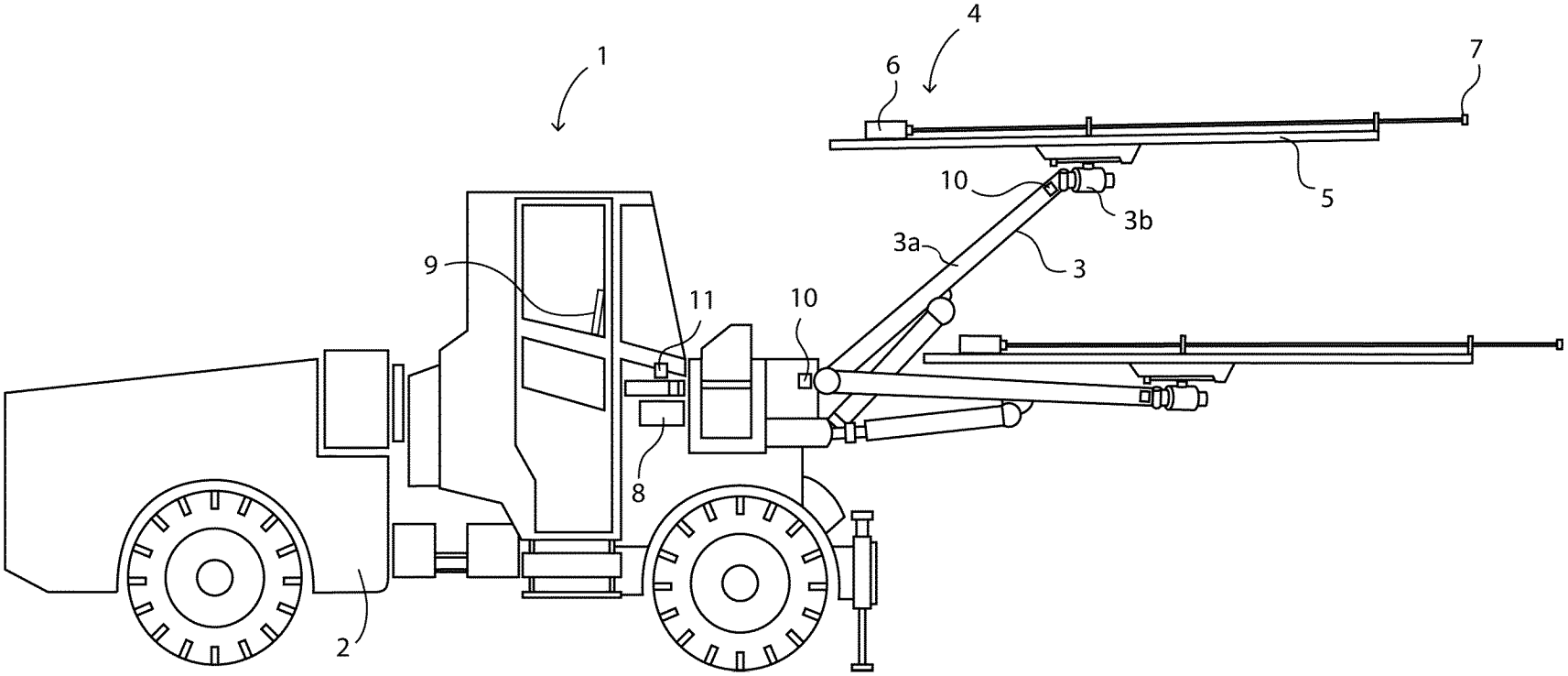
FIG. 1 illustrates an example of an underground vehicle in accordance with some embodiments.

As an example of a mine vehicle in which at least some of the embodiments may be illustrated, FIG. 1 illustrates a rock drilling rig 1 comprising a carrier 2, one or more drilling booms 3 and drilling units 4 arranged in the drilling booms 3. The boom may comprise two or more parts, object, or portions 3*a*, 3*b* connected by a joint. The boom is further connected to a drilling unit 4 by a joint. The drilling unit 4 comprises a feed beam 5 on which a rock drilling machine 6 can be moved by means of a feed device. Further, the drilling unit 4 comprises a tool 7 with which the impact pulses given by the percussion device of the rock drilling machine are transmitted to the rock to be drilled.

The rock drilling rig 1 further comprises at least one control unit 8 arranged to control actuators of the rock drilling rig 1, for example. The control unit 8 may comprise one or more processors executing computer program code stored in a memory, and it may comprise or be connected to a user interface with a display device 9 as well as operator input interface for receiving operator commands and information to the control unit 8. In some embodiments, the control unit 8 is configured to control at least boom automation control related operations, and there may be one or more other control units in the rig for controlling other operations.

FIG. 1 further discloses that one or more sensors 10 may be arranged for determining current position and direction of portions of the boom 3 and further the tool 7. Such sensors 10 may locate in connection with the boom 3, or alternatively the sensing may be executed remotely from the carrier or even elsewhere. The sensing data may be provided to the control unit 8 (or another control unit for positioning), which may execute appropriate computations.

The drilling rig 1 may comprise at least one scanner unit 11 for scanning tunnel profile. Point cloud data generated on the basis of scanning may be applied for generating and updating 3D tunnel model, which may be applied for positioning the drilling rig 1 in the tunnel, for example. In some embodiments, the scanning results are applied to detect position and orientation of the rig 1 and one or more further elements thereof, such as the tool 7. This may enable to avoid or reduce number of specific sensors 10 for determining the position and direction of the rig elements.

In some embodiments, the rig 1 or the control unit 8 thereof may execute a point cloud matching program for matching operational point cloud data (being scanned by the drilling rig 1) to tunnel model cloud data. Position and direction of the scanning device and/or another interest point of the machine 1, such as the (leading edge of the) tool 7, may be determined in the mine coordinate system on the basis of the detected matching between the operational point cloud data and the reference cloud data. Such scanning and point cloud matching based positioning may be used instead or in addition to other positioning means in the machine, such the positioning based on the (position) sensors and tachymetry.

It is to be appreciated that FIG. 1 provides only one example and many other configurations are applicable. For example, instead of a drilling unit, another type of work machine may be attached to the boom 3, such as a bolting unit, a concrete sprayer, a platform, a scaling unit, or an explosives charger unit, for example. Instead of two booms, there may be only single boom or more than two booms, such as three or even four booms in a single drilling rig. It is to be also noted that in some alternative embodiments the mine vehicle is unmanned. Thus, the user interface may be remote from the machine and the machine may be remotely controlled by an operator in the tunnel, or in control room at the mine area or even long distance away from the mine via communications network(s).

A drilling pattern or plan, or other type of mine work plan, such as a bolting plan, is defining work tasks carried out by the drilling rig and may be used as an input for automatic control of one or more booms of the mine vehicle, such as the drilling rig 1. The plan may define a plurality of target poses for a work machine of the mine vehicle, such as hole positions and orientations, on the basis of which boom movement control is arranged. The plan may be designed offline and off-site, for example in an office, or on-board the drilling rig. Such plan may be sent via a wired or wireless connection to, or otherwise loaded to the mine vehicle, e.g. to a memory of the rock drilling rig 1 for access by the control unit 8. It is to be noted that there may be also certain other predefined target poses for the work machine and/or the boom, such as a predefined boom haulage pose applied when the mine vehicle is driven in the tunnel. Further example embodiments are illustrated below particularly in connection with drilling rigs, but it will be appreciated that at least some of the below illustrated embodiments, such as those illustrated in connection with FIGS. 3 to 5, may be applied in other types of mine vehicles applying a mine work plan for controlling movement of a boom.

Figure 2:
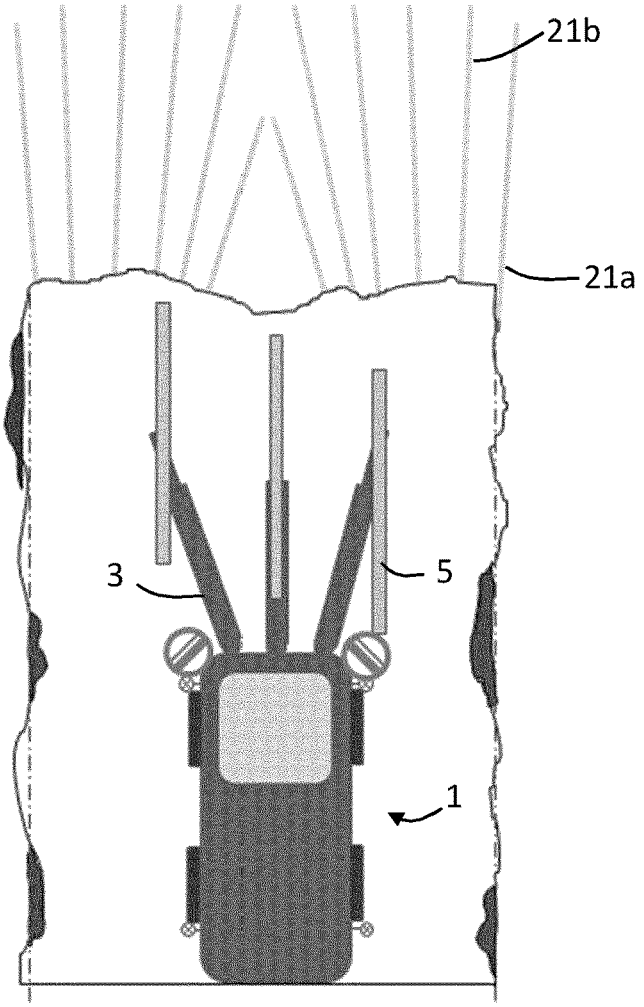
FIG. 2 illustrates a top view of a drilling rig and tunnel excavation.

In case of a drilling plan, the control unit 8 may also control drilling work cycle actions on the basis of the hole information in the drilling plan. The operator 12 of the rock drilling rig 1 may control the drilling interactively with the control unit 8. With reference to FIG. 2, illustrating a top view of a tunnel and drilling rig 1, the drilling plan defines positions and orientations of holes 21*a*, 21*b* to be drilled which may be arranged in several drill hole rows.

Figure 3:
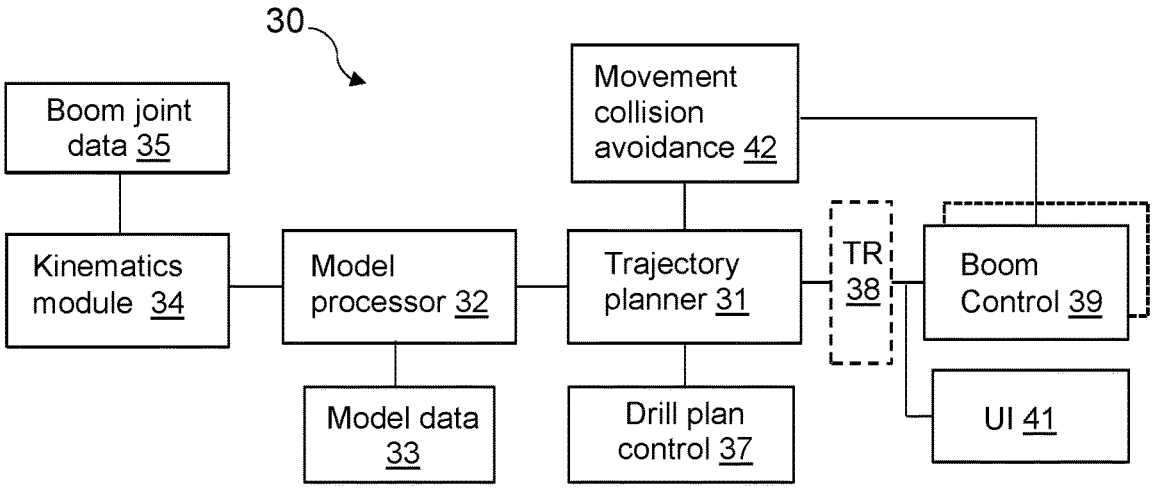
FIG. 3 illustrates a control system or apparatus a for a mine vehicle according to at least some embodiments.

There are now provided further improvements for automatic boom movement control, based on specific boom trajectory generation control or logic, further illustrated below. FIG. 3 illustrates operational modules for a control apparatus, system or unit 30 for boom control and collision-free positioning for an underground mine vehicle, such as the control unit 8 for the drilling rig 1 according to some embodiments.

The apparatus 30 may be configured to provide multi-level or layer collision avoidance architecture. A drill plan control module 37 may be configured to perform drill plan logic, which may be considered as highest level of collision avoidance. In other embodiments, module 37 may be a work plan module configured to execute operations on the basis of another type of mine work plan, e.g. provide input of target poses to the trajectory planner. A boom trajectory planner (BTP) module 31 may be configured to perform trajectory planning logic, which may be considered as middle level collision avoidance.

The apparatus may further comprise, or be connected to, a movement collision avoidance (MCA) module 42, configured to take care of collision avoidance measures during movement of one or more booms. The MCA may also be referred to as kinematics collision avoidance module and may be considered as the lowest level of collision avoidance, and as "last line of defense".

The MCA module 42 may be configured to take care of collision avoidance measures during movement of one or more booms, e.g. on the basis of scanning the surroundings of the mine vehicle (all relationships not shown). In response to detecting the boom moving too close to an obstacle the MCA module 42 may take precautionary measures, and cause a control signal to boom control module 39 to stop the boom movement or cause change in the trajectory of the boom being executed. In some embodiments, the MCA module 42 (or the apparatus 30/mine vehicle or drilling rig 1 in general) may be configured to carry out at least some of the on-line collision prevention features during movement of the boom illustrated in an earlier patent application WO2018/184916.

Various embodiments are now particularly focused on the trajectory planner operations, and FIG. 3 further illustrates interfaces to the BTP 31 and further modules related to the BTP 31.

A kinematics module 34 may receive joint data 35 of one or more booms B1, B2. The joint data may indicate current position of each joint of the respective boom. The kinematics module 34 may define current position and orientation of each monitored and controlled boom object, such as a given portion or part of a single or multi-part boom, which may be referred to current or start pose of the boom portion, in a coordinate system of the mine vehicle.

A model processor module 32 may receive from the kinematics module 34 information of the current position and orientation of each monitored and controlled boom object. In some embodiments, this information is provided by transformation matrices generated by the kinematics module 34.

The model processor module 32 may also receive geometry data, or model data, of the boom objects from a model data repository, such as a memory connected to a processor configured to perform the module 32. In some embodiments, the geometry data comprises point cloud data of the boom objects.

The model processor module 32 is configured to map the geometry data (model) of a boom object to the current position and orientation (start pose) of the boom object. In some embodiments, a point cloud file of the boom object is mapped to the start pose of the boom object. This may be carried out by matching the point cloud with an appropriate transformation matrix (of the respective boom object) and positioning the boom object point cloud in correct start pose based on the transformation matrix.

The BTP module 31 is configured to perform, before starting positioning of a boom, and the work machine for the target pose, positioning trajectory generation for generating boom trajectory information 38 for controlling at least one boom object from a starting position to a target position for positioning the work machine to a target pose in accordance with the mine work plan.

Figure 4:
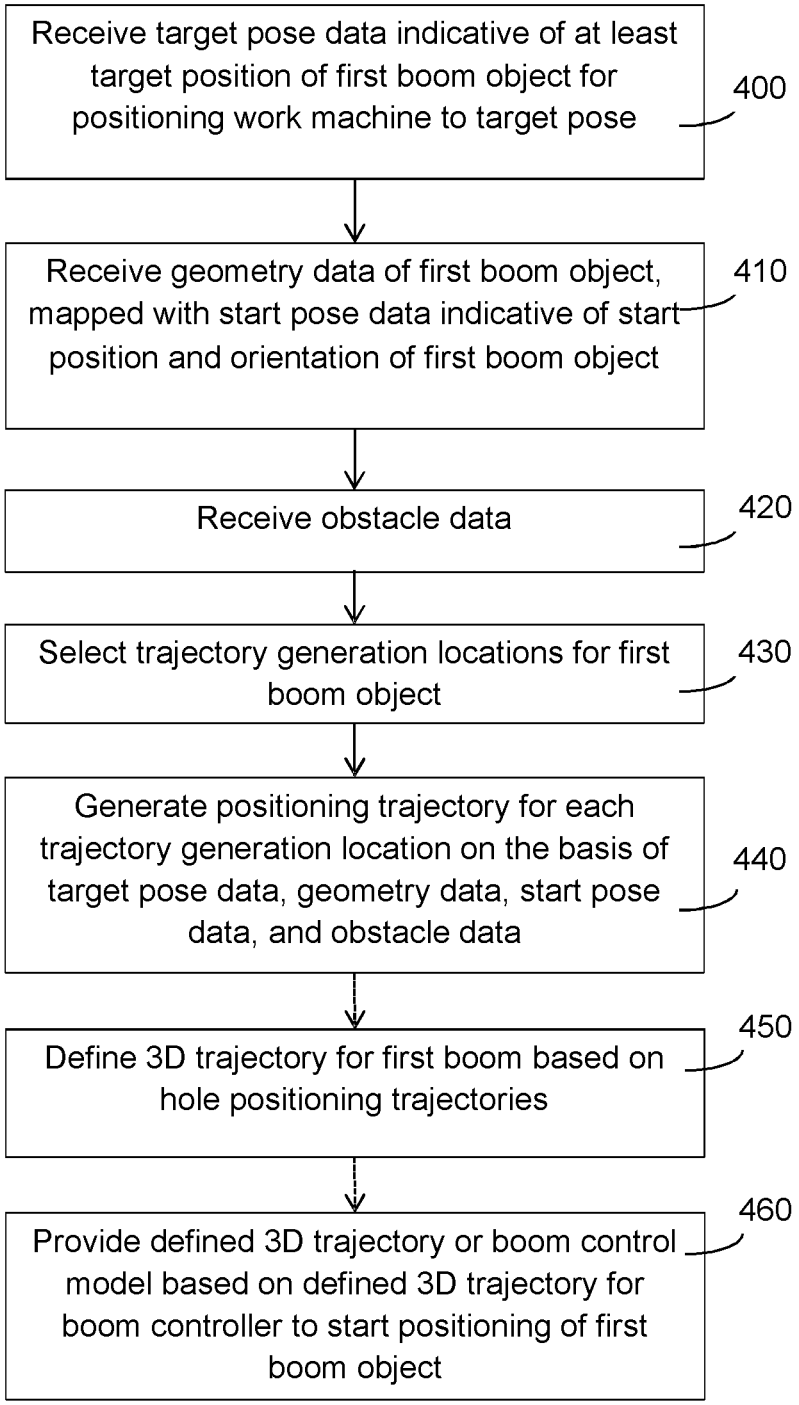
FIGS. 4 and 5 illustrate methods according to at least some embodiments.

FIG. 4 illustrates a method according to some embodiments. The method may be performed by the mine vehicle, in some embodiments the apparatus 30, and by the BTP module 31 thereof.

In some embodiments, the positioning trajectory generation comprises receiving 400 target pose data indicative of at least target position of the first boom object for positioning the work machine to the target pose defined in the mine work plan, receiving 410 geometry data of the first boom object, mapped with start pose data indicative of the start position and orientation of the first boom object, receiving 420 obstacle data, selecting 430 trajectory generation locations for the first boom object, and generating 440 a positioning trajectory for each of the selected trajectory generation locations on the basis of the target pose data, the geometry data, the start pose data, and the obstacle data.

Thus, "slices" at selected locations of the modelled boom (object) may be captured, which may be in 2D plane, at which the trajectory may be efficiently defined. The number of the trajectory locations for the first boom object may vary and may be is also selected as part of the method (e.g. in block 430). Trajectories may thus be selected to be generated at critical locations of the boom. It will be appreciated that at least some of the blocks (400-430) may be carried out in another order. Some other and further example embodiments are illustrated below, again referring also to FIG. 3.

At least some of the trajectories are after block 440 applied (directly or indirectly) for controlling the respective boom when the boom movement is initiated. Boom trajectory information 38 based on or comprising at least some of the trajectories generated in 440 may be sent from the BTP module 31 to a boom controller, which may be configured to generate a boom control model based on the trajectory information 38. Control signals may be generated for boom actuator(s) for moving the first boom object in accordance with the boom trajectory information 38.

In some embodiments, the BTP module 31 is further configured to define 450 a 3D trajectory for the boom (or the boom object) on the basis of at least some the positioning trajectories. Thus, 3D position coordinates may be defined for the boom object trajectory. The 3D trajectory (or a boom control model based on the 3D trajectory) may then be sent 460 for the boom controller 39. In another embodiment, at least some the positioning trajectories are sent as the boom trajectory information 38 to the boom controller 39.

The method may be applied in real-time during execution of the mine work plan assigned for the drilling rig. For example, step 400 may be entered instantly after concluding a preceding work task involving a preceding in the mine work plan, such as after finishing drilling of a preceding hole in a drilling plan.

In some embodiments, the positioning trajectories are generated 440 by a trajectory experimentation algorithm configured to experiment available trajectory options by applying a set of cost functions. Some examples of methods that may be applied by the BTP module 31 for calculating trajectories comprise Dijkstra and A* algorithms.

The BTP module 31 may be configured to calculate cost factor information on the basis of the set of cost functions for each of a set of available trajectory point options, and a trajectory point is selected among the set of trajectory point options on the basis of the cost factors of the trajectory point options.

The cost functions may comprise, but are not limited to, at least some of: distance to the target position, distance from the start position, distance to the (at least one) obstacle, direction of obstacle circumvention, and distance to another object or portion of the boom or another boom. The direction of obstacle circumvention may be relevant, e.g. since the configuration of the drilling rig 1 may be such that it does not enable to circumvent the obstacle at one direction. It will be appreciated that the application and weighting of cost functions may be implemented in numerous ways. Naturally, the aim typically is to minimize total trajectory length while securing a guard distance to all obstacles.

The BTP module 31 may be configured to define one or more dead zones on the basis of at least some of the information received in 400-420. The available trajectory options are experimented by the algorithm in a space outside of the defined dead zone. This enables to reduce available trajectory point options and hence trajectory generation computation time.

The trajectory generation locations may be selected 440 on the basis of predefined selection criteria and parameters. In a simple example, the BTP module 31 may be configured to configured to select the trajectory generation locations at a predefined location of a boom portion head, a boom portion tail, and/or a boom portion center. In some embodiments, the selection is based on further of dynamic input parameters, such as outcome of preceding trajectory generation cycle or an input indicative if another boom is being moved.

The BTP module 31 may be configured to select the trajectory generation locations and/or a number of trajectories for the first boom object on the basis of a user input and/or an outcome of a preceding trajectory generation cycle. For example, the BTP 31 decides to determine five positioning trajectories and selects locations for these five trajectories in block 430.

The BTP module 31 may be configured to continuously perform the method and update the positioning trajectories during positioning of the first boom at least on the basis of updated position of the first boom object and the updated position(s) of the object(s). The blocks may be repeated at each computation cycle of the apparatus.

In some embodiments the apparatus 30, e.g. the BTP module 31, is provided with 3D scanning data produced by at least one scanning device, which may be attached to the drilling rig 1. The scanning data may be utilized as the obstacle data of at least one of the objects. In some embodiments, drilling rig portions are detected and positioned based on scanned point cloud data, such as scanned boom objects (instead of or in addition to the positioning based on boom joint data 35).

In some embodiments, pose of the first boom object is modelled on the basis of a 3D geometry data of the first boom object and a start position and orientation of the first boom object in a 3D coordinate system, such as the mine or drilling plan coordinate system, or the coordinate system of the drilling rig 1. The trajectory generation locations may be selected 430 in the modelled pose of the first boom object. The positioning trajectories may be generated 440 at the selected locations on the basis of the modelled pose of the first boom object in the applied coordinate system.

Figure 5:
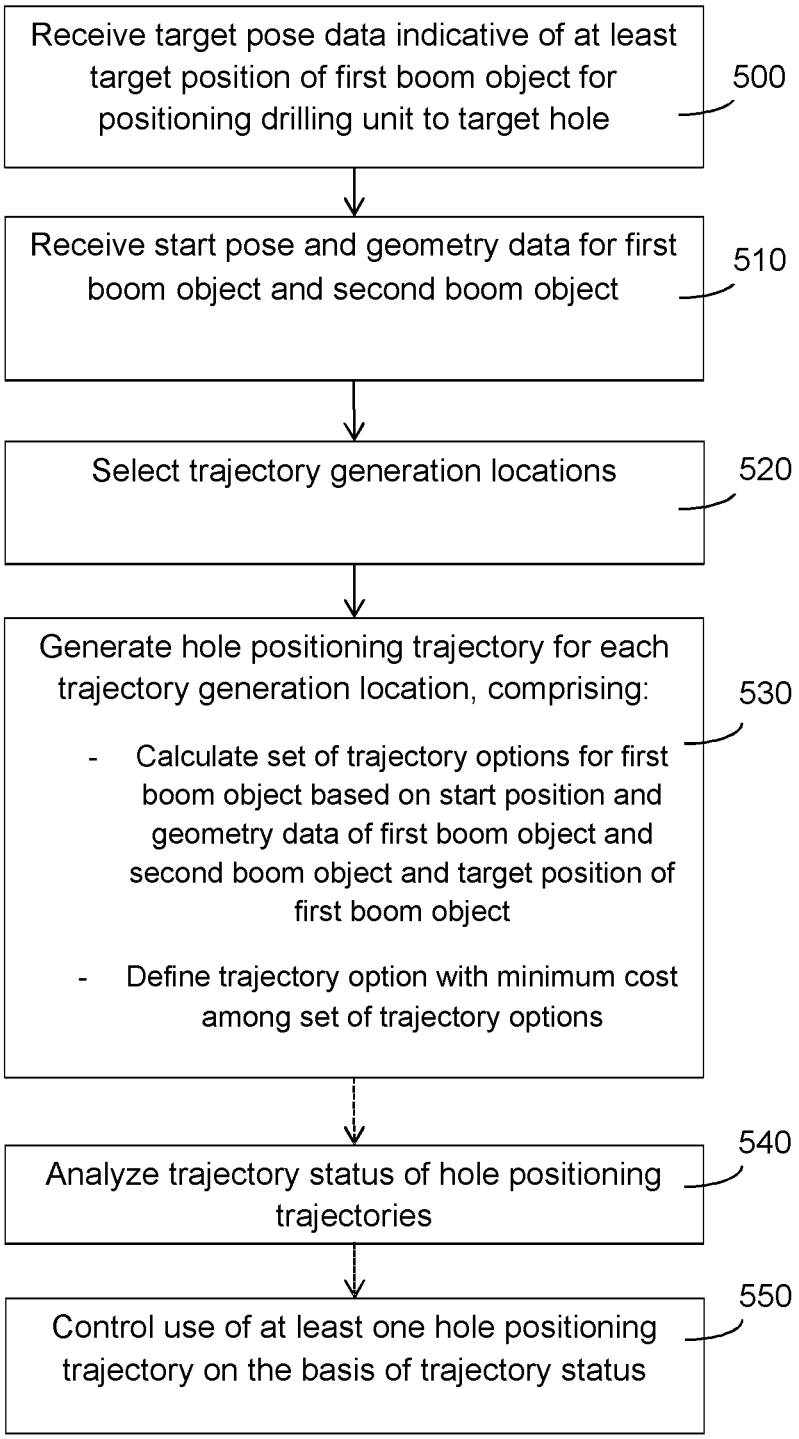
Figure 6A:
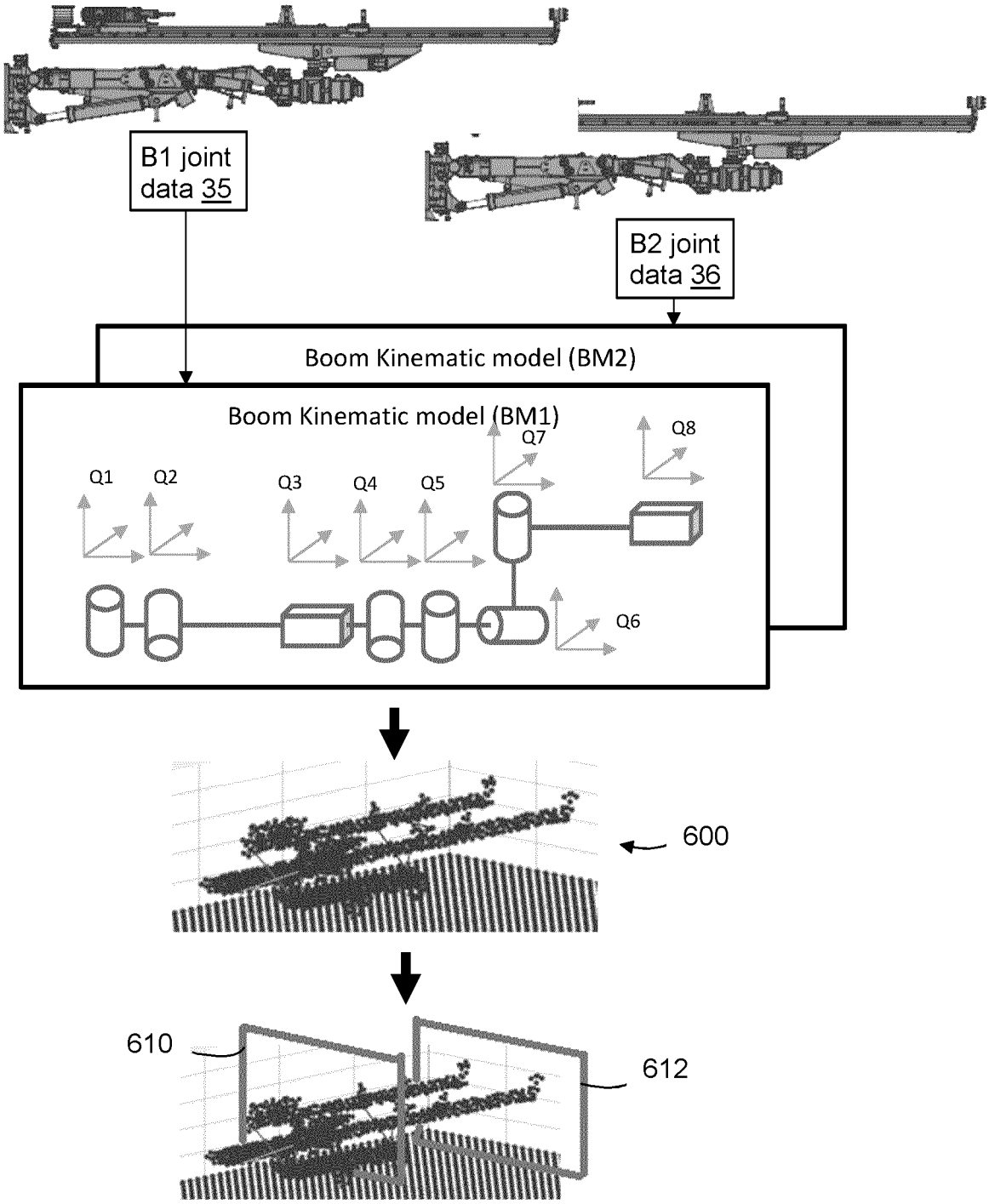
FIGS. 6*a* and 6*b* illustrate trajectory generation for mine vehicle comprising multiple booms in accordance with at least some embodiments.
Figure 6B:
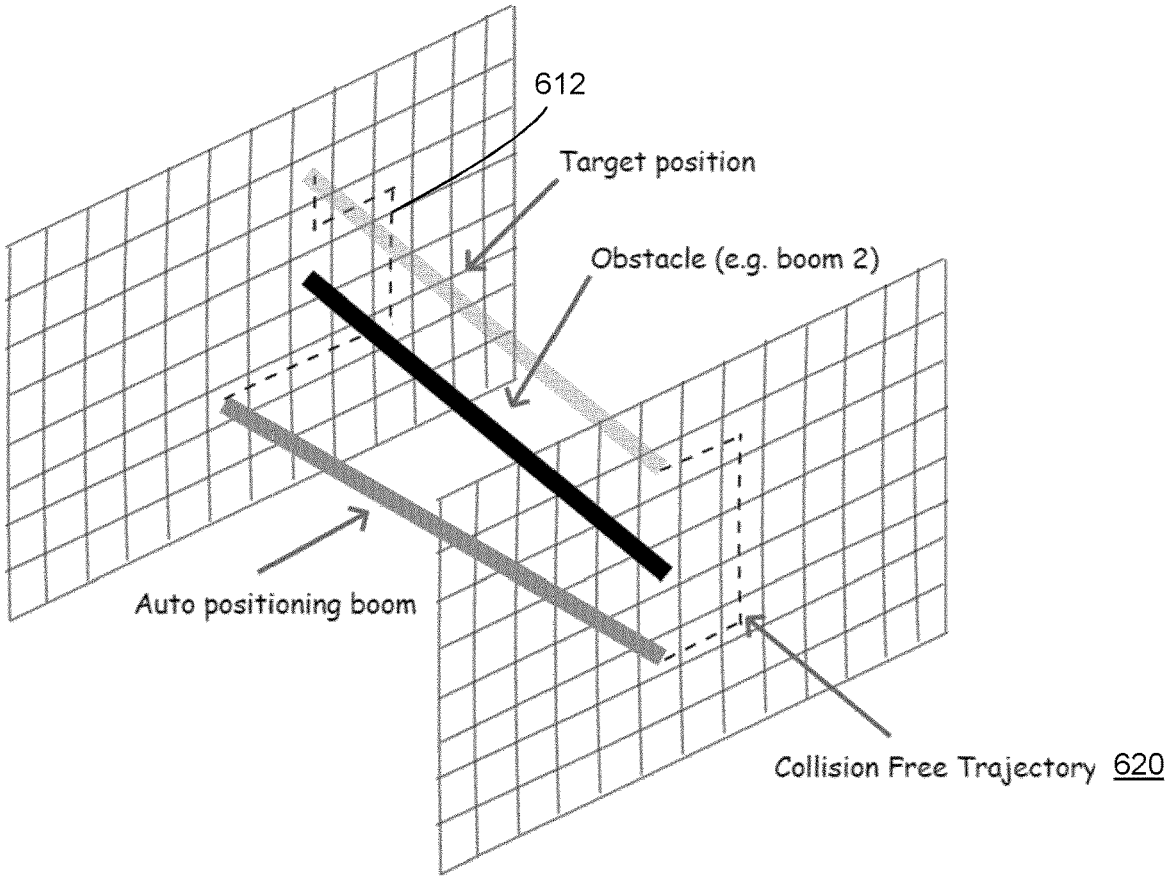

In some embodiments at least some of the presently disclosed features are applied for collision avoidance between at least two booms of a mine vehicle, such as the drilling rig 1. FIGS. 5, 6*a*, and 6*b* illustrate simplified example embodiments for trajectory information generation based on assessment of two drilling boom objects, which may be of or for separate booms.

Target pose data for the first boom object (for which trajectory is now being generated for positioning a drilling unit (or in particular a tool thereof) attached to the first boom to the target pose defined in a drilling plan) is received 500.

Start pose and geometry data for the first boom object and for a second boom object are received 510. Trajectory generation locations are selected 520. Hole positioning trajectory is generated 530 for each selected location, wherein the trajectory generation comprises:

calculating, on the basis of geometry data and position of the first boom object and geometry data and position of a second boom object, a set of available trajectory options by a trajectory experimentation algorithm, and selecting a trajectory option with minimum cost among the trajectories in the set.

It is to be noted that, depending on the applied algorithm, the trajectory options may comprise a portion of the trajectory from the start pose to the target pose, and the trajectory is generated portion-by-portion by repeating the above steps. Cost functions may be applied, as illustrated above. The steps may be repeated even for assessing one node or point at a time to be next added for the trajectory.

As illustrated in FIG. 6*a*, the kinematics module 34 may generate boom object (e.g. joint) positions based on boom 1 joint data 35 and boom 2 joint data 36, and respective boom kinematics models BM1 and BM2. The poses of the first boom object and the second boom object may be modelled 600 on the basis of a 3D geometry data of the boom objects and a position and orientation of the boom objects in the 3D coordinate system. Although not shown, it will be appreciated that other objects (of the drilling rig and/or in the environment thereof) may be modelled 600, e.g. on the basis of the 3D scanning data.

The positioning trajectories are calculated on the basis of the modelled poses of the first boom object and the second boom object. The trajectory generation locations 610, 612 may be selected 430, 520 in the modelled poses 600 of the first boom object. Simplified examples of the trajectories 620, 622 at the selected locations are further illustrated in FIG. 6*b*.

As further illustrated in FIG. 5, in some embodiments the BTP module 31 may be configured to analyze 540 trajectory status of the trajectory generation procedure and/or at least some of the positioning trajectories.

The BTP module 31 may further control 550 subsequent actions for boom movement control, such as use of the respective positioning trajectory, on the basis of the trajectory status. In some embodiments, the trajectory status may specify or indicate: does the trajectory require bypassing around an obstacle, is the current or target pose inside an obstacle range (error situation), difficulty of the trajectory, etc.

For example, if trajectories 1-3 of five generated trajectories do not detect need for evasive action (to avoid collision), they may be discarded and trajectories 4-5 are applied 550 as the boom trajectory information 38.

In another example, the positioning of the first boom object may be delayed on the basis of the trajectory status, or change to another target pose or target hole of the mine work plan may be controlled on the basis of the trajectory status. It is to be noted that the status analyzation and further use thereof, as well as other embodiments introduced in connection with FIGS. 5, 6*a*, and 6*b*, may be applied outside the example embodiment of these Figures.

Various of embodiments are available associated with the UI 41 on the basis of the method carried out by the BTP module 31 and the trajectory information 38, only some example embodiments being illustrated herewith.

The apparatus may be configured to cause at least the some of the generated trajectories for display for an operator. This is particularly relevant for the operator to be confident on appropriate subsequent actions, instead of being "blind" on how the automation will move the boom. The UI 41, e.g. a touch screen, may be configured to provide input option(s) for the operator to obtain further information on and/or amend the planned trajectories.

Further, the apparatus 30 may be configured to inform the operator in response to a predefined trigger condition in the trajectory planning procedure requiring operator attention being met. This may be based on the trajectory status. For example, in response to no available trajectory being found, the BTP 31 may cause an indication for the operator to manually control the drilling rig. In another example, the BTP 31, or another control module of the drilling rig, is configured to determine a corrective control action for one or more components of the drilling rig, after which a trajectory for the first boom object for positioning the work machine to the target pose can be generated. For example, an indication is sent to a boom controller of the second boom to move the second boom.

In some embodiments, the MCA module 42 is connected to the BTP module 31. The MCA module 42 is configured to execute a collision examination process during the movement of at least the boom for positioning the work machine to the target pose on the basis of at least some of the positioning trajectory information 38 generated by the BTP module 31. The MCA module 42 may be adapted to:

- receive information on current position and orientation of the first boom object and an obstacle in a 3D coordinate system,
- examine risk of collision of the boom further moving in accordance with the at least some of the generated positioning trajectories, and
- execute a collision avoidance process for preventing the moving first boom object to collide to the obstacle.

The MCA module 42 may be configured to receive first 3D geometry data on the first boom object and second 3D geometry data of the second boom object. The MCA module 42 may examine the risk of collision of the first boom object and the second boom object on the basis of shortest distance between the first 3D geometry data aligned on the basis of the current position and orientation of the first boom object and the second 3D geometry data aligned on the basis of the current position and orientation of the second boom object.

The MCA module 42 may be adapted, in response to detecting a collision risk for the first boom object, perform:

- define an updated set of positioning trajectories and/or joint values for the first boom object to avoid the collision,
- provide information of the collision risk to the BTP module 31, which is configured to, in response to the information, define an updated set of positioning trajectories to avoid the collision, or
- cause an input to a mine work plan controller for adapting order of target poses and/or pose parameters in the mine work plan.

It is to be noted that the modules of FIG. 3 may be implemented by one or more physical devices. For example, boom control 39 may be arranged in devices separate from a collision device or server comprising e.g. the trajectory planner 31.

It is to be appreciated that various further features may be complement or differentiate at least some of the above-illustrated embodiments. For example, there may be further user interaction and/or automation functionality further facilitating the operator to study the trajectories, select appropriate action to overcome an issue regarding boom trajectory/positioning, and control the mine vehicle and the boom(s) thereof.

An electronic device comprising electronic circuitries may be an apparatus for realizing at least some embodiments illustrated above, such as the method illustrated in connection with FIGS. 4 and/or 5. The apparatus may be comprised in at least one computing device connected to or integrated into a control system of the mine vehicle. Such control system may be an intelligent on-board control system controlling operation of various sub-systems of the mine vehicle, such as a hydraulic system, a motor, a rock drill, etc. Such control systems are often distributed and include many independent modules connected by a bus system of controller area network (CAN) nodes, for example.

Figure 7:
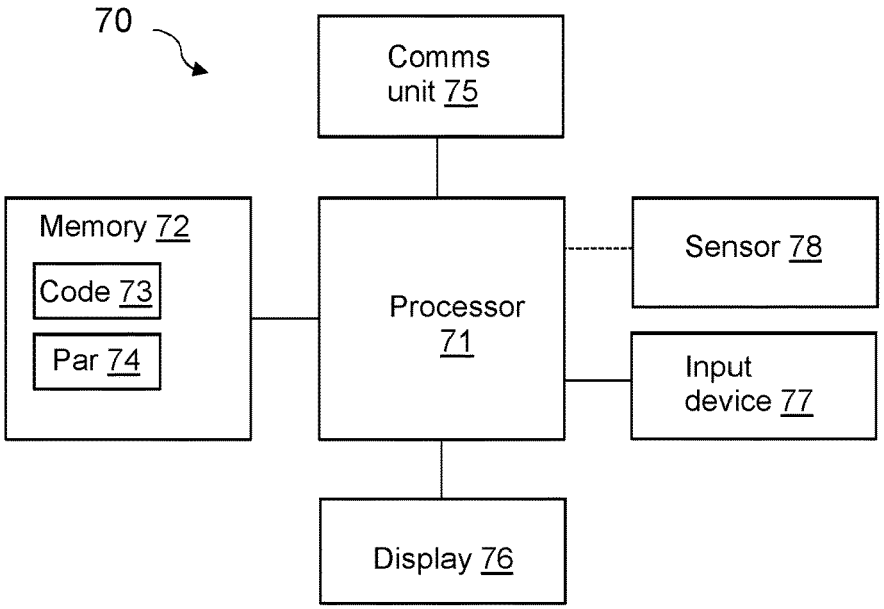
FIG. 7 illustrates an example apparatus capable of supporting at least some embodiments.

FIG. 7 illustrates a simplified example apparatus capable of supporting at least some embodiments of the present invention. Illustrated is a device 70, which may be configured to carry out at least some of the embodiments relating to the mine vehicle boom trajectory control related operations illustrated above. In some embodiments, the device 70 comprises or implements the control unit 8, the apparatus 30, and/or the BTP module 31 thereof.

Comprised in the device 70 is a processor 71, which may comprise, for example, a single- or multi-core processor. The processor 71 may comprise more than one processor. The processor may comprise at least one application-specific integrated circuit, ASIC. The processor may comprise at least one field-programmable gate array, FPGA. The processor may be configured, at least in part by computer instructions, to perform actions.

The device 70 may comprise memory 72. The memory may comprise random-access memory and/or permanent memory. The memory may be at least in part accessible to the processor 71. The memory may be at least in part comprised in the processor 71. The memory may be at least in part external to the device 70 but accessible to the device. The memory 72 may be means for storing information, such as parameters 74 affecting operations of the device. The parameter information in particular may comprise parameter information affecting e.g. the boom trajectory generation and related features, such as threshold values.

The memory 72 may be a non-transitory computer readable medium comprising computer program code 73 including computer instructions that the processor 71 is configured to execute. When computer instructions configured to cause the processor to perform certain actions are stored in the memory, and the device in overall is configured to run under the direction of the processor using computer instructions from the memory, the processor and/or its at least one processing core may be considered to be configured to perform said certain actions. The processor may, together with the memory and computer program code, form means for performing at least some of the above-illustrated method steps in the device.

The device 70 may comprise a communications unit 75 comprising a transmitter and/or a receiver. The transmitter and the receiver may be configured to transmit and receive, respectively, i.a. data and control commands within or outside the mine vehicle. The transmitter and/or receiver may be configured to operate in accordance with global system for mobile communication, GSM, wideband code division multiple access, WCDMA, long term evolution, LTE, 3GPP new radio access technology (N-RAT), wireless local area network, WLAN, and/or Ethernet standards, for example. The device 70 may comprise a near-field communication, NFC, transceiver. The NFC transceiver may support at least one NFC technology, such as NFC, Bluetooth, or similar technologies.

The device 70 may comprise or be connected to a UI, such as the UI 41 illustrated in connection with FIG. 3. The UI may comprise at least one of a display 76, a speaker, an input device 77 such as a keyboard, a joystick, a touchscreen, and/or a microphone. The UI may be configured to display views on the basis of above illustrated embodiments. A user may operate the device and control at least some of above illustrated features. In some embodiments, the user may control the apparatus 30 or the rig 1 via the UI, for example to manually operate a boom, change operation mode to and from automatic boom positioning, change display views, modify parameters 74, in response to user authentication and adequate rights associated with the user, etc.

The device 70 may further comprise and/or be connected to further units, devices and systems, such as one or more sensor devices 78 sensing environment of the device 70 and/or sensor devices detecting position of a joint.

The processor 71, the memory 72, the communications unit 75 and the UI may be interconnected by electrical leads internal to the device 70 in a multitude of different ways. For example, each of the aforementioned devices may be separately connected to a master bus internal to the device, to allow for the devices to exchange information. However, as the skilled person will appreciate, this is only one example and depending on the embodiment various ways of interconnecting at least two of the aforementioned devices may be selected without departing from the scope of the present invention.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the preceding description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

The invention claimed is:

1. An apparatus for generating instructions for controlling a boom of an underground mine vehicle having at least one boom, wherein the boom is movable by a boom actuator, and is attachable to a mine work machine, the apparatus being configured to control a first boom object of the boom for positioning the work machine to a target pose on the basis of a hole position and orientation in accordance with a mine work plan, wherein the apparatus comprises at least one processing core, at least one memory including computer program code, the at least one memory and the computer program code being configured to, with the at least one processing core, cause the apparatus at least to:

perform, before starting positioning of the work machine for the target pose, positioning trajectory generation for controlling the first boom object from a starting position to a target position for positioning the work machine to the target pose, the positioning trajectory generation comprising:

receiving target pose data indicative of at least target position of the first boom object for positioning the work machine to the target pose on the basis of the hole position and orientation in accordance with the mine work plan;

receiving geometry data of the first boom object, the geometry data being mapped with start pose data indicative of the start position and orientation of the first boom object;

receiving obstacle data;

selecting trajectory generation locations for the first boom object; and generating, by a trajectory experimentation algorithm configured to experiment available trajectory options by applying a set of cost functions, a positioning trajectory for each of the selected trajectory generation locations on the basis of the target pose data, the geometry data, the start pose data, and the obstacle data; and applying at least some of the positioning trajectories for controlling the respective boom when boom movement is initiated.

2. The apparatus of claim 1, wherein the at least one memory and the computer program code are further configured to, with the at least one processing core, cause the apparatus to define a 3D trajectory for the boom on the basis of at least some the positioning trajectories.

3. The apparatus of claim 1, wherein the at least one memory and the computer program code are further configured to, with the at least one processing core, cause the apparatus provide boom trajectory information based on at least some of the positioning trajectories to a boom controller configured to define boom actuator control commands on the basis of the received boom trajectory information.

4. The apparatus of claim 1, wherein the at least one memory and the computer program code are further configured to, with the at least one processing core, cause the apparatus to:

model pose of the first boom object on the basis of a 3D geometry data of the first boom object and a start position and orientation of the first boom object in a 3D coordinate system;

select the trajectory generation locations in the modelled pose of the first boom object; and calculate the positioning trajectories at the selected locations on the basis of the modelled pose of the first boom object.

5. The apparatus of claim 4, wherein the mine vehicle comprises at least two booms and the at least one memory and the computer program code are further configured to, with the at least one processing core, cause the apparatus to:

model pose of a second boom object of a second boom of the on the basis of a 3D geometry data of the second boom object and a position and orientation of the second boom object in the 3D coordinate system; and calculate the positioning trajectories on the basis of the modelled poses of the first boom object and the second boom object.

6. The apparatus of claim 1, wherein the work machine includes a rock drill attached to a feed beam connected to the boom, the mine work plan being a drilling plan including target positions and orientations for each hole in a set of holes to be drilled, and wherein the positioning trajectories are hole positioning trajectories.

7. The apparatus of claim 1, wherein the at least one memory and the computer program code are further configured to, with the at least one processing core, cause the apparatus to select the trajectory generation locations based on predefined selection criteria from at least one of a boom portion head, a boom portion tail, and a boom portion center.

8. The apparatus of claim 1, wherein the at least one memory and the computer program code are further configured to, with the at least one processing core, cause the apparatus to analyze trajectory status for at least one of the positioning trajectories, and control use of the positioning trajectory on the basis of a trajectory status of the positioning trajectory.

9. The apparatus of claim 1, wherein the at least one memory and the computer program code are further configured to, with the at least one processing core, cause the apparatus to select the trajectory generation locations and/or a number of trajectories for the first boom object on the basis of a user input and/or an outcome of a preceding trajectory generation cycle.

10. The apparatus of claim 1, wherein the set of cost functions includes at least some of distance to the obstacle, direction of obstacle circumvention, and distance to another object of the boom.

11. The apparatus of claim 1, wherein the at least one memory and the computer program code are further configured to, with the at least one processing core, cause the apparatus to cause at least the some of the generated trajectories for display for an operator, or, in response to no available trajectory being found, cause an indication for the operator to manually control the mine vehicle and/or determine a control action for one or more components of the mine vehicle after which a trajectory for the first boom object for positioning the work machine to the target pose can be generated.

12. The apparatus of claim 1, wherein the at least one memory and the computer program code are further configured to, with the at least one processing core, cause apparatus to execute a collision examination process during movement of the boom for positioning the work machine to the target pose on the basis of at least some of the generated positioning trajectories, the at least one memory and the computer program code being further configured to, with the at least one processing core, to:

receive information on current position and orientation of the first boom object and an obstacle in a 3D coordinate system;

examine risk of collision of the boom further moving in accordance with the at least some of the generated positioning trajectories; and execute a collision avoidance process for preventing the moving first boom object to collide to the obstacle, adapted, in response to detecting a collision risk for the first boom object, and being arranged to:

i. define an updated set of positioning trajectories and/or joint values for the first boom object to avoid the collision;

ii. provide information of the collision risk to the boom trajectory planner configured to define an updated set of positioning trajectories to avoid the collision; or iii. cause an input to a mine work plan controller for adapting order of target poses and/or pose parameters in the mine work plan.

13. An underground mine vehicle, comprising:

a carrier;

at least one boom having at least two boom parts and a plurality of boom joints; and a mine work machine attached a distal end portion of the at least one boom, wherein the mine vehicle includes the apparatus according to claim 1.

14. A method performed by an apparatus comprising at least one processing core, at least one memory including computer program code, the at least one memory and the computer program code being configured to, with the at least one processing core, cause the apparatus at least to perform the method for generating instructions for controlling a boom of an underground mine vehicle having at least one boom by a boom trajectory planner, the method comprising the steps of:

receiving target pose data indicative of at least target position of a first boom object of the boom for positioning a work machine of the mine vehicle to a target pose on the basis of a hole position and orientation in accordance with a mine work plan;

receiving geometry data of the first boom object, the geometry data being mapped with start pose data indicative of the start position and orientation of the first boom object;

receiving obstacle data;

selecting trajectory generation locations for the first boom object;

generating, by a trajectory experimentation algorithm configured to experiment available trajectory options by applying a set of cost functions, before starting positioning of the work machine for the target pose, a positioning trajectory for each of the selected trajectory generation locations on the basis of the target pose data, the geometry data, the start pose data, and the obstacle data; and applying at least some of the positioning trajectories for controlling the respective boom when boom movement is initiated.

15. A non-transitory computer readable medium comprising computer program code, when executed in a data processing apparatus, for causing a method in accordance with claim 14 to be performed.

* * * * *